United States Patent [19]

Irwin

[11] Patent Number: 4,542,543

[45] Date of Patent: Sep. 24, 1985

[54] IMPACT DEVICE

[76] Inventor: Lawrence F. Irwin, 12860 San Fernando Rd., Sylmar, Calif. 91342

[21] Appl. No.: 602,412

[22] Filed: Apr. 20, 1984

[51] Int. Cl.[4] ..... E03D 11/00

[52] U.S. Cl. ..... 4/255; 417/493

[58] Field of Search ..... 4/255–257; 417/493

[56] References Cited

U.S. PATENT DOCUMENTS

| | | | |
|---|---|---|---|
| 1,769,061 | 7/1930 | Hitchcock | 4/255 X |
| 1,901,031 | 3/1933 | Humason | 417/493 X |
| 2,267,064 | 12/1941 | Wikelund | 4/255 |
| 2,274,304 | 2/1942 | Perry | 4/255 |
| 2,386,870 | 10/1945 | Lawton | 4/255 |
| 2,498,359 | 2/1950 | Coleman | 4/255 |
| 2,582,535 | 1/1952 | Drouot | 417/493 |
| 4,053,955 | 10/1977 | Canham | 4/255 |
| 4,096,597 | 6/1978 | Duse | 4/255 |
| 4,238,860 | 12/1980 | Dixon | 4/256 |

*Primary Examiner*—Charles E. Phillips

*Attorney, Agent, or Firm*—James E. Brunton

[57] ABSTRACT

A mechanically operated impact tool adapted for use in clearing blockages in clogged waste lines. The tool embodies a pair of telescopically movable sleeves which house an anvil and a reciprocating piston. A coil spring functions to drive the piston against the anvil when one of the sleeves is moved telescopically over the other a predetermined distance.

11 Claims, 11 Drawing Figures

IMPACT DEVICE

BACKGROUND OF THE INVENTION

1. Field of the Invention

The present invention relates generally to waste line cleanout tools. More particularly the invention concerns a device which will create a series of shock reactions in the backed up water in a clogged waste line tending to break loose the blockage in the line.

2. Discussion of the Prior Art

Various types of tools have been suggested for clearing stoppages in clogged drains or waste lines. Many of these tools embody plungers, reciprocating pistons or suction devices which are adapted to create water or air pressure within the clogged line to attempt to clear the blockage. These devices are often cumbersome, difficult to use and frequently fail to generate sufficient pressures upon the blockage to clear the line or, could under circumstances of a severe blockage, cause a back pressure sufficient to post a hazard to the operator.

Certain types of prior art cleanout tools have been designed to create a shock wave, or shock reaction, in the water in the clogged line to attempt to loosen the blockage. Some of these devices include means for also exerting a water pressure on the blockage in addition to the shock reaction. Exemplary of this type of apparatus is that disclosed in U.S. Pat. No. 4,053,955 issued to Canham. This device, which uses an electromagnetic unit to create an anvil-type of striking action against a piston to cause the shock reaction, represents the most pertinent art known to the present inventor.

SUMMARY OF THE INVENTION

It is an object of the present invention to provide a simple, easy to use, non-electric, mechanically operated cleanout tool for clearing blockages in waste lines and the like by causing a series of shock reactions in the water backed up within the clogged line.

Another object of the invention is to provide a tool of the aforementioned character which is compact, sturdy, highly reliable and readily adaptable for use in wash basins, bath tubs, and toilets as well as in other types of household and industrial waste line inlets.

A further object of the invention is to provide a tool of the type described which can be operated in a manner to produce a series of rapid fire, sharp impacts on the water in the clogged line so as to repeatedly impact the blockage thereby causing it to break loose and thereby efficiently clear the line.

Still another object of the invention is to provide a cleanout tool of the class described which is inexpensive, lightweight and can be easily operated by a person of small stature not having great physical strength.

DESCRIPTION OF ONE EMBODIMENT OF THE INVENTION

Figure 1:
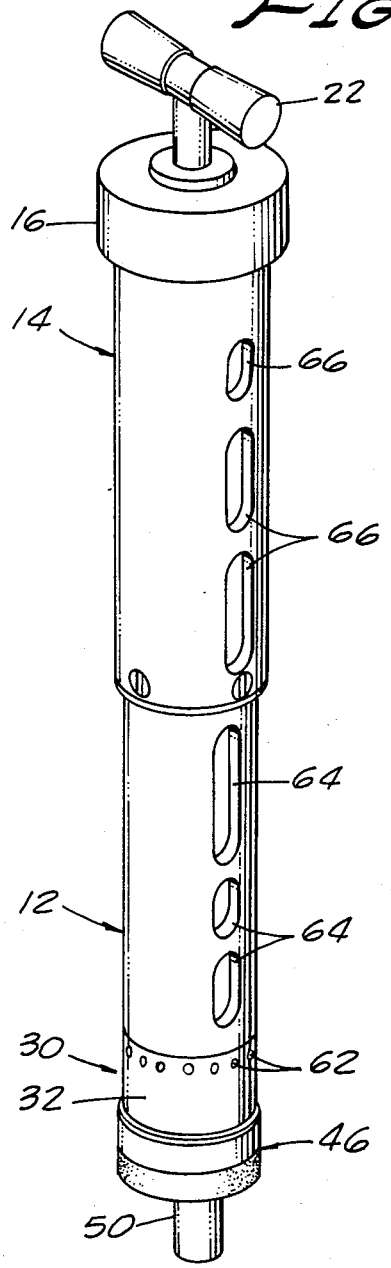
FIG. 1 is a generally perspective view of the waste line cleanout tool of the present invention.
Figure 2:
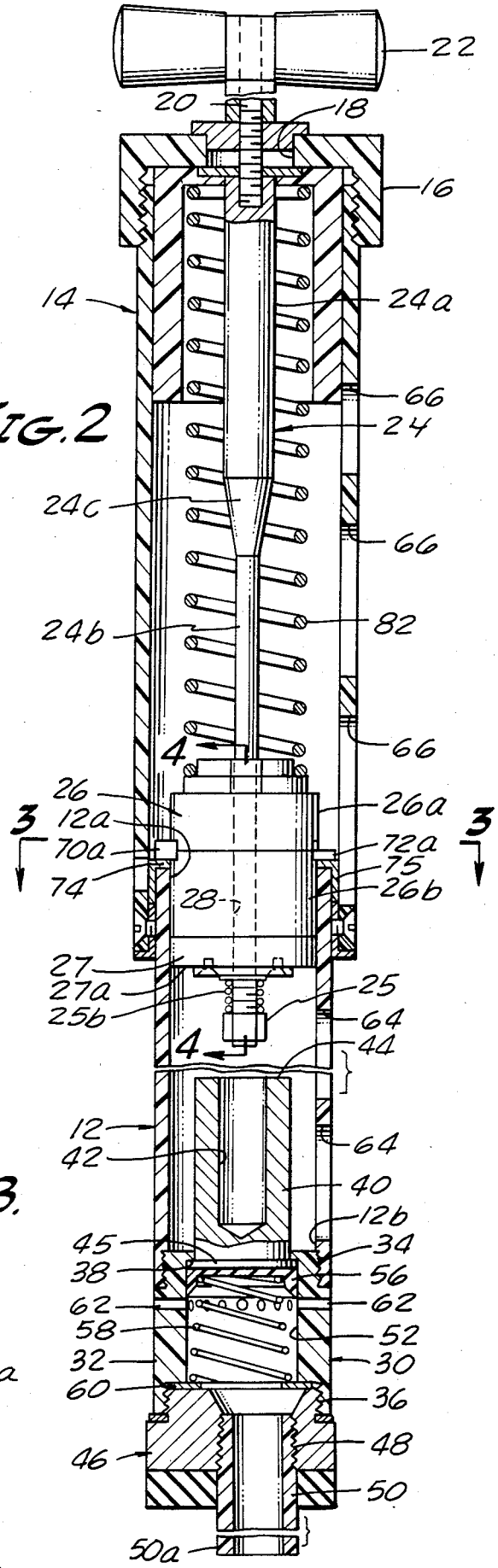
FIG. 2 is an enlarged side elevational cross-sectional view of the tool.
Figure 3:
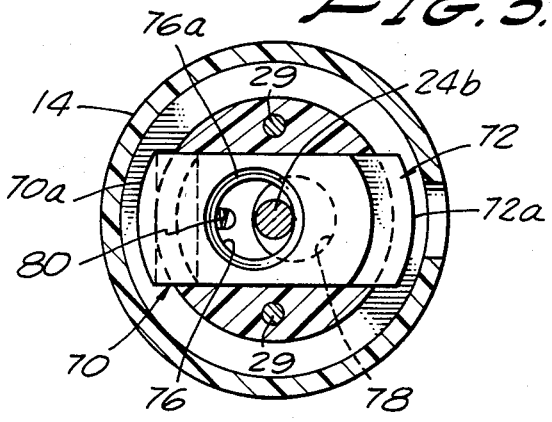
FIG. 3 is a cross-sectional view taken along lines 3—3 of FIG. 2 illustrating the configuration of the releasable locking means of the invention.

Referring to the drawings and particularly to FIGS. 1, 2 and 3, the cleanout, or impact, device of the present invention comprises telescopically interconnected first and second elongated casings 12 and 14. Upper casing 14 is closed at one end by a closure cap 16 which is threadably interconnected with external threads formed proximate the upper end of casing 14. Cap 16 is provided with a central bore 18 (FIG. 2) adapted to receive a threaded shank portion 20 of a handle member 22. Threaded shank member 20 is adapted to be threadably interconnected with an elongated, downwardly depending connecting rod 24, the purpose of which will presently be described.

Referring particularly to FIG. 2, first, or lower, casing 12 is open at a first upper end **12*a* and is adapted to receive for reciprocal movement therewithin a first piston 26 which is provided with an axially extending bore 28 therethrough. The second end 12*b* of casing 12 is internally threaded to permit interconnection with casing 12 of an impact generating means, or impact assembly 30 for exerting an impact force against the stoppage in the waste line sought to be cleared by the use of the tool of the invention. The impact assembly 30 of the present form of the invention comprises a generally cylindrically shaped body 32 which is internally threaded at a first end 34 for threadable interconnection with first casing 12. Body 32 is also internally threaded at its second, opposite end 36 and is counterbored to define an internal shoulder 38**, the purpose of which will presently be described.

Provided for limited reciprocal movement within body 32 is an anvil 40. Anvil 40 is provided with an axially extending central bore 42, an upper annular shaped surface 44 adapted to be forcibly impacted by the lower surface **27*a* of an end cap 27 connected to piston 26 and an enlarged diameter lower rim portion 45** defining a shoulder adapted to engage shoulder 38 of body 32.

Threadably interconnected with body 32 at the second end 36 thereof is a closure member 46 which is provided with an internally threaded bore 48. Bore 48 is radially offset from the axial centerline of second casing 12 and is adapted to threadably receive a short cylindrical pipe section 50, the end 50*a* of which extends outwardly from the closure member 46 a limited distance.

With the components of the impact assembly joined together in the manner illustrated in FIG. 2 there is defined an internal chamber 52 into which the lower rim portion of anvil 40 protrudes a limited distance. Also provided within internal chamber 52 is a second piston 56 formed of an elastomeric material. Piston 56 is adapted to move reciprocally within chamber 52 in response to movement of anvil member 40 downwardly into chamber 52. To yieldably resist such downward movement of second piston 56 and anvil 40 there is provided a second biasing means, shown here in the form of a helical coiled spring 58, one end of which engages piston 56 and the other end of which engages a washer 60 which is disposed intermediate closure cap 46 and body 32. To limit as much as possible any impedance to the downward movement of piston 56 within chamber 52, there is provided a multiplicity of venting apertures 62 which extend through the side walls of body 32. As best seen in FIG. 1, casings 12 and 14 are also provided with a plurality of axially spaced apart openings 64 and 66 respectively to permit the escape of any air trapped internally of the device during reciprocal movement of casing 14 over casing 12.

Figure 9:
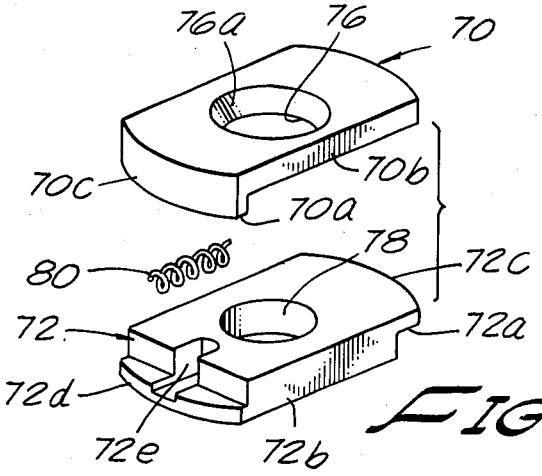
FIG. 9 is an enlarged, generally perspective view illustrating the configuration of the locking means of the present form of the invention.

Forming an important aspect of the apparatus of the present invention is locking means which are movable from a first to a second position. In their first, extended position the locking means function to initially prevent downward movement in a first direction of piston 26 within casing 12. Referring also to FIGS. 3 and 9, the locking means of the present embodiment of the invention can be seen to comprise a pair of transversely extending, radially movable cooperating locking members 70 and 72. Each of the locking members has a peripheral portion 70*a* and 72*a* respectively adapted to engage an annular shoulder 74 defined by an annular shaped reinforcing sleeve 75 which closely fits over open end 12*a* of casing 12 (FIG. 2).

As best seen by referring to FIGS. 3 and 9, locking members 70 and 72 are generally planar in shape and each is provided with a circularly shaped aperture identified by the numerals 76 and 78. As indicated in FIG. 3, apertures 76 and 78 are radially off center from the axial centerline of the mating sleeves 12 and 14. Additionally, aperture 76 is provided with an inwardly tapering surface 76*a*, the purpose of which will presently be described.

Figure 4:
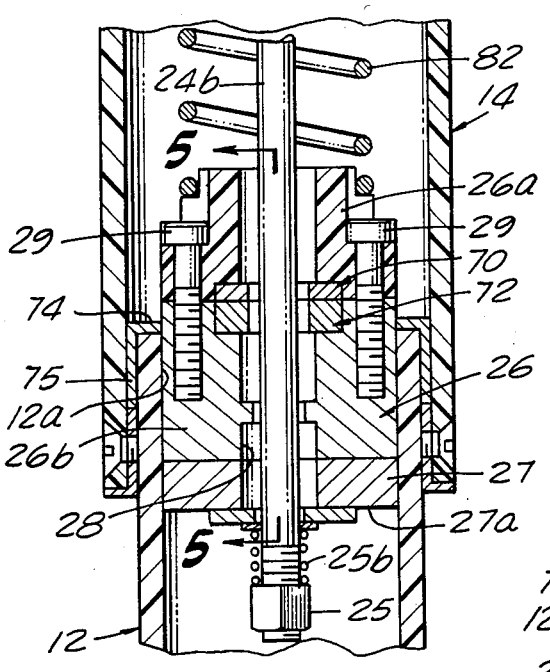
FIG. 4 is an enlarged cross-sectional view taken along lines 4—4 of FIG. 2.
Figure 5:
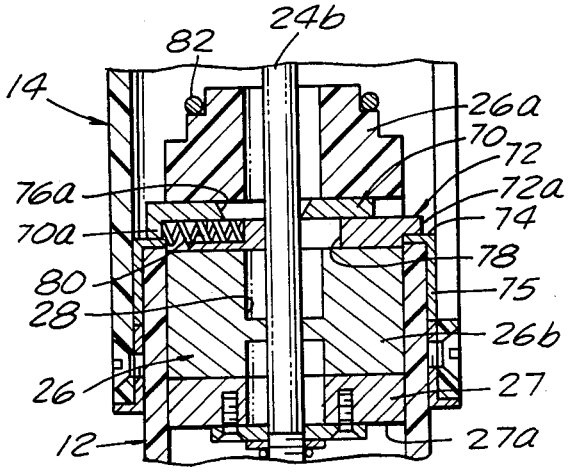
FIG. 5 is a cross-sectional view taken along lines 5—5 of FIG. 4.
Figure 7:
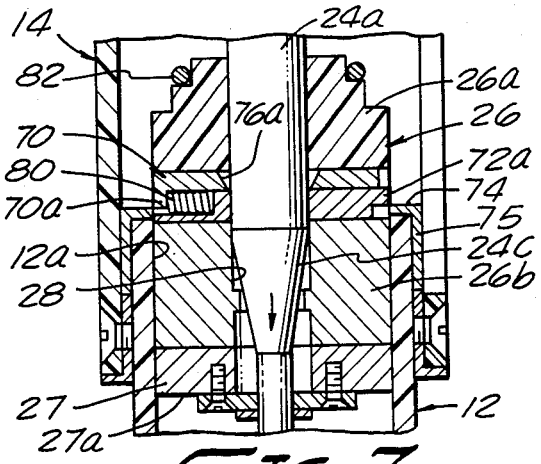
FIG. 7 is an enlarged fragmentary cross-sectional view of the central portion of the tool illustrated in FIG. 6 showing the manner in which the locking members are operably retracted as a result of the downward movement of the outer sleeve and the internal connecting rod of the tool during a second stage of the impact generating mode.

Turning now to FIGS. 4 and 5, it will be observed that members 70 and 72 are normally disposed in sliding engagement between upper and lower slotted piston portions 26*a* and 26*b* respectively, which portions are removably interconnected together by fasteners 29. Members 70 and 72 are adapted for movement from an extended locking position, as shown in FIG. 5, to a retracted position, as shown in FIG. 7. Referring also to FIG. 9, it will be observed that member 70 has a main planar body portion 70*b* and a curved downwardly depending peripheral portion 70*c*. Similarly, member 72 has a central planar portion 72*b* and a curved radially outwardly extending peripheral portion 72*d*. Member 72 is further provided with a step portion 72*a* located opposite peripheral portion 72*d*, which portion is provided with a radially extending cavity 72*e*. Cavity 72*e* is adapted to house a second biasing means shown here in the form of a coiled spring 80 which functions to yieldably resist slidable movement of members 70 and 72 relative to one another from an extended position into a retracted position. The manner of movement of members 70 and 72 by the operating means of the invention will be further described hereinafter in the "Operations" section.

Referring once again to FIG. 2, second cylindrical casing 14, which is telescopically movable over first casing 12, houses the previously identified connecting rod 24, which comprises the locking means operating mechanism of this form of the invention. Casing 14 also houses a first biasing means shown in the drawings in the form of an elongated helical spring 82 which is interposed between the upper surface of piston 26 and the lower surface of closure cap 16. In this position, the first biasing means, or spring 82, yieldably resists telescopic movement of second casing 14 over first casing 12 so long as the locking means of the invention are in the extended position shown in FIG. 2. Connecting rod 24 is generally circular in cross-section at any point and includes an enlarged diameter portion 24*a* which is threadably connected to shank 20 of handle 22. Rod 24 also includes a reduced diameter portion 24*b* which extends through axial bore 28 formed in piston 26. Portion 24*b* is threaded at its lower extremity to removably receive a nut 25 which, along with a coiled spring 25*b*, functions to operably interconnect rod 24 and piston 26. Formed intermediate portions 24*a* and 24*b* of the connecting rod is a generally cone shaped portion 24*c* which functions as the engaging means of the present form of the invention for engaging locking members 70 and 72 to effect radially inward movement thereof from an extended position into a retracted position as a result of the telescopic movement of casing 14 over casing 12 a predetermined distance.

OPERATIONS

Figure 6:
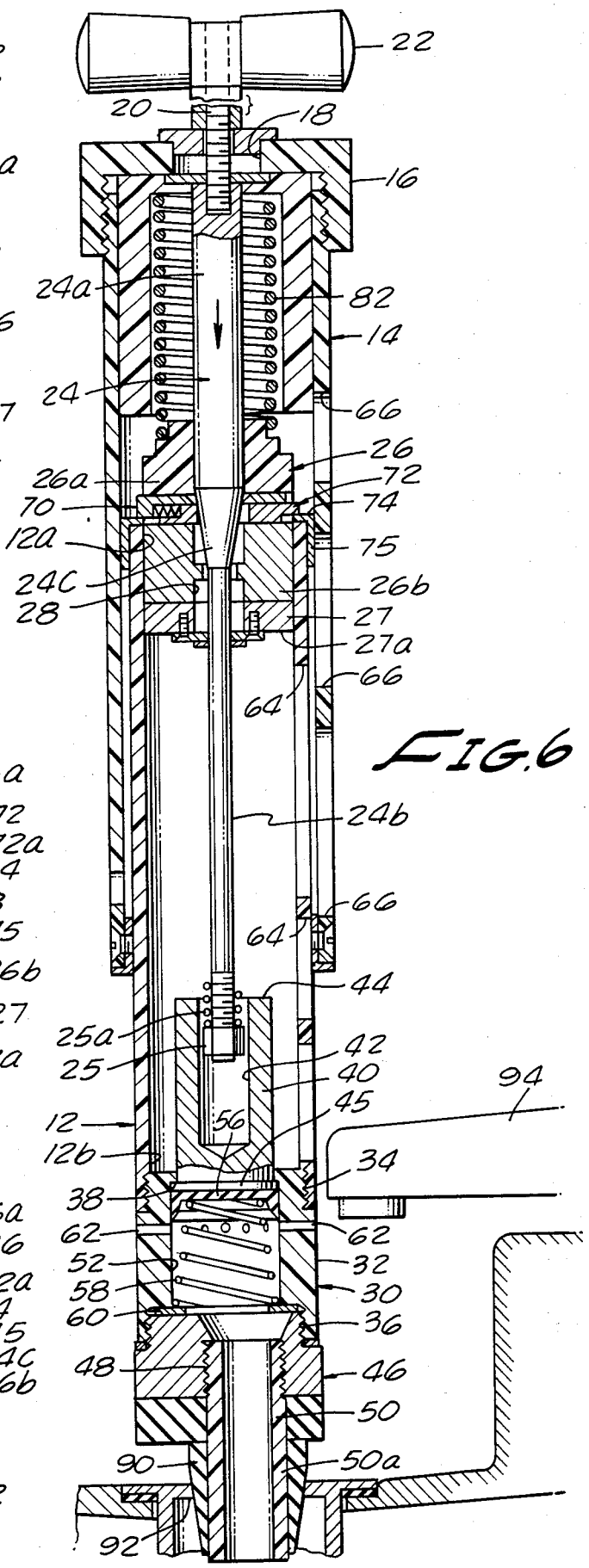
FIG. 6 is a cross-sectional view of the cleanout tool similar to that shown in FIG. 2 but illustrating the appearance of the device in engagement with a waste line inlet and in the first stage of an impact generating mode.

Turning now to FIG. 6, the impact tool of the invention is shown in sealable engagement with the waste line inlet of a bathroom sink of typical configuration. For this purpose, a tapered fitting 90 is emplaced over cylindrical pipe section 50. Fitting 90 is preferably constructed of an elastomeric material adapted to sealably fit within the opening to the drain line 92. It will be observed that as a result of the axial offset of the cylindrical pipe section 50, the tool may be disposed in a vertical position within the drain line opening without interference by the water faucet 94. This axial offset feature of the device makes the device readily usable in the manner shown in most bathroom and kitchen sinks of standard configuration.

With the tool of the invention in the position indicated in FIG. 6 and fitting 90 being in sealable engagement with the clogged waste line opening 92, water which has not been able to drain from the sink into the clogged waste line will enter hollow pipe fitting 50 and will fill chamber 52. A downward pressure is then exerted on handle 22 which causes casing 14 to telescopically travel over the upper body portion of casing 12. Because the locking means, or locking members 70 and 72, are in their extended position in engagement with upper shoulder 74 (see also FIG. 5), the coiled spring 82 will yieldably resist the downward telescopic movement of casing 14 over casing 12. It will be observed by comparing FIGS. 2 and 6 that as casing 14 is moved downwardly compressing spring 82, connecting rod 24 will also move downwardly from the position shown in FIG. 2 into the position shown in FIG. 6. As the lower end portion of connecting rod 24 moves through the apertures 76 and 78 formed in the locking member, the side walls, or engaging means, of conical portion 24*c* of the connecting rod will move into engagement with the tapered wall portion 76*a* of aperture 76 and tending to move member 70 radially inwardly (to the right as viewed in FIG. 5) with respect to the axial center line of the telescoping casings 12 and 14. It is also to be noted that as the connecting rod 24 moves downwardly to the position shown in FIG. 6, the lower end portion thereof, including nut 25 and spring 25*a*, will move into central bore 42 formed in anvil 40.

Turning now to FIG. 7, continued downward pressure on handle 22 will cause further telescopic movement of casing 14 over casing 12 and the continued downward movement of connecting rod 24 to the position illustrated in FIG. 7. As indicated in FIG. 7, a full downward movement of casing 14 will cause the cone shaped portion 24*c* of the connecting rod to move through the apertures 76 and 78 formed in the locking members causing them to move radially inwardly into the fully retracted position shown in FIG. 7. At this point, the connecting rod 24 has moved from the position shown in FIGS. 2, 4 and 5, into a complete downward position shown in FIG. 7 causing complete retraction or withdrawal of the locking members 70 or 72 inwardly of the upper annual opening of casing 12. At this point, since the locking members no longer are in engagement with shoulder 74, piston 26 is free to move telescopically downward within casing 12. Further, because at the point of full retraction of the locking members, coil spring 82 is fully compressed, full retraction of the locking members will result in the coil spring 82 exerting a substantial force on piston 26 forcibly driving the lower impact surface 27*a* thereof into impact engagement with shoulder 44 formed on anvil 40.

Figure 8:
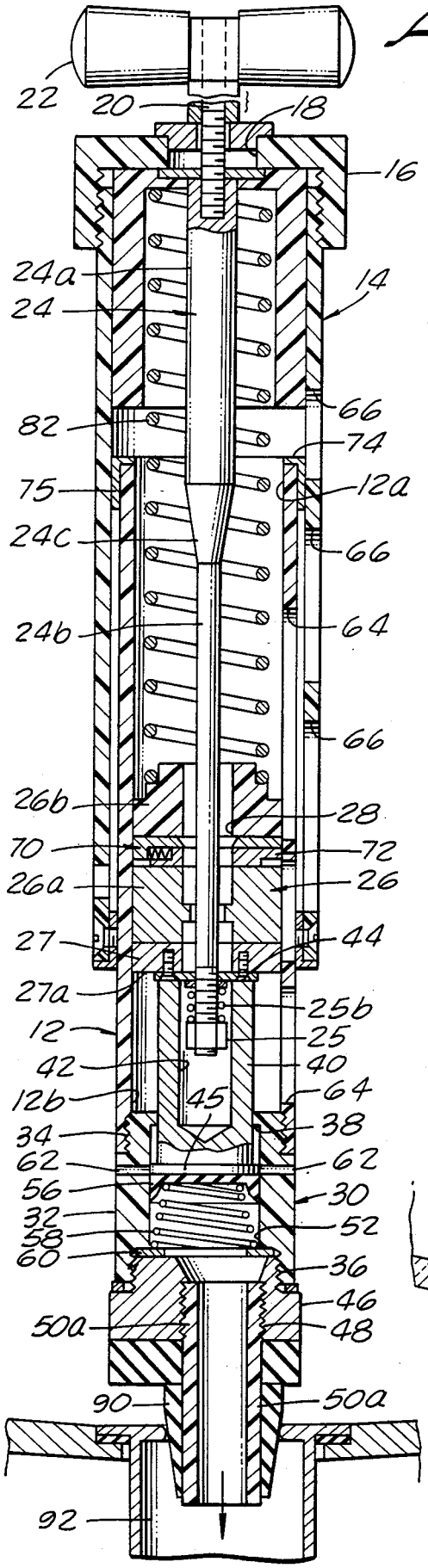
FIG. 8 is a cross-sectional view similar to that shown in FIG. 6 but illustrating the appearance of the components of the device when the device is in its fully compressed, third stage impact generating made.

Turning now to FIG. 8, the component parts of the apparatus are shown as they appear following the forcible impact on anvil 40 by piston 26. It is to be noted from FIG. 8 that the impact of the piston on the anvil has caused second piston 56 to move downwardly within chamber 52 against the resistance of spring 58. It is this sharp movement of anvil 40 and piston 56 into chamber 52 which results in a substantial impact force being exerted upon the water column extending from the bottom of piston 56, through the waste line to the clog, or blockage, located in the waste line downstream of the inlet. More particularly, this impact force exerted against the column of water forms a shock wave which travels through the column of water and ultimately impinges sharply upon the blockage tending to clear the blocked line.

Following the operation of the device as thus described, an upward force exerted on handle 22 will return the components of the device to the starting configuration illustrated in FIG. 2. In this position, coil spring 58 has urged second piston 56 upwardly into engagement with the lower portion of anvil 40 which has also been urged upwardly within casing 12 to the position shown in FIG. 2. Similarly, when first piston 26 reaches the location shown in FIG. 2, spring 80 (see FIG. 5) will urge the locking members 70 and 72 radially outwardly to their extended or locked position.

By once again exerting a downward force on handle 22, the process described in the immediately preceding paragraphs is repeated and another sharp impact force can be exerted against the column of water and in turn against the blockage in the line. Repeated cycling of the device in the manner described will result in the effective and rapid disintegration, or clearing, of the blockage within the waste line.

Figure 10:
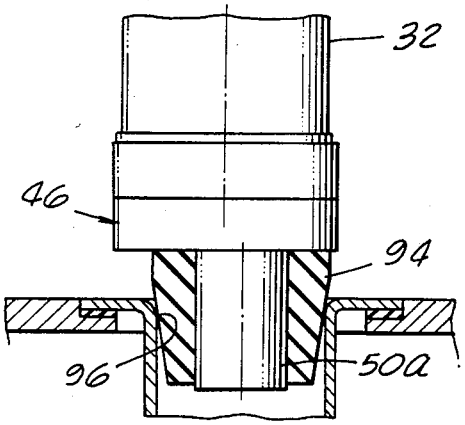
FIG. 10 is an enlarged fragmentary view of the lower portion of the tool showing the manner in which the tool can be sealably engaged with the inlet of a waste line of a different size and construction from that shown in FIG. 8.

Turning to FIG. 10 there is illustrated another type of fitting, or adapter, 94 which can be positioned over tube section 50 to permit the tool to be placed into sealable engagement with a waste line opening 96 of the slightly different configuration illustrated in FIG. 10. Such an opening might, for example, be found in a kitchen or laundry sink.

Figure 11:
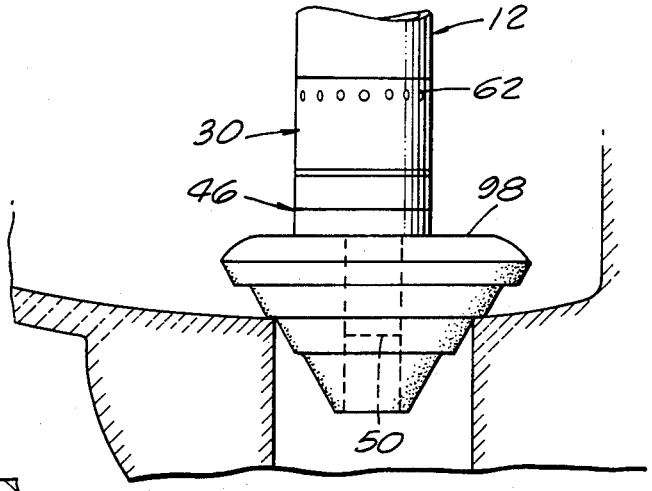
FIG. 11 is a fragmentary elevational view of the end portion of the device illustrating the use of still another type of sealing adaptor to permit the tool to be placed in sealable engagement with the drain opening of a conventional toilet.

Referring to FIG. 11 there is illustrated yet another form of fitting 98 which can be emplaced over tube section 50 to enable the device to be used with toilets of conventional design to clear blockages located in the waste line down stream of the water inlet of the toilet.

While the fittings 90, 94 and 98 may be constructed of a variety of materials, experience has shown that an elastomeric rubber or yieldable, but durable, plastic material will effectively seal the inlet to the waste line enabling the device to perform in an efficient manner. While the drawings illustrate particular configurations of the fittings, it is to be understood that fittings of various sizes and shapes can be constructed for use with particular types of waste line inlets such as those found in floors, walls or in sewer clean out access openings provided in residences and commercial buildings. In a similar vein, fittings of the general character illustrated in FIG. 11 and designated by the numeral 98 can be constructed in a generally frustoconical configuration so that a single fitting can be conveniently used in connection with waste line openings of differing diameters.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An impact device for use in clearing stoppages in waste lines, comprising:

(a) a first elongated casing;

(b) a piston reciprocally movable within said first casing;

(c) locking means movable from a first to a second position for preventing movement of said piston within said first casing in a first direction when said locking means are in a first position;

(d) an impact assembly mounted at one end of said first casing, said assembly including;

(i) an anvil adapted to be forcibly impacted by said piston;

(ii) an internal chamber disposed adjacent said anvil, said anvil being movable into said chamber a limited distance upon being impacted by said piston;

(iii) a closures member, including a protruding pipe section defining a passageway leading from said internal chamber to the exterior of the device; and (iv) a fitting attached to said pipe section for sealable engagement with the inlet of the waste line;

(e) a second elongated casing telescopically receivable over said first casing;

(f) biasing means operably associated with said second casing and said piston for yieldably resisting telescopic movement of said second casing over said first casing when said locking means re in a first position; and (g) operating means operably associated with said second casing for operating said locking means to cause movement thereof from said first to said second position upon said casing being moved telescopically over said first casing a predetermined distance against the urging of said biasing means whereby upon movement of said locking means to said second position said biasing means will cause said piston to forcibly impact said anvil.

2. An impact device as defined in claim 1 in which said first casing is provided with an annular shoulder adjacent one end thereof and in which said locking means comprises a pair of transversely extending, readially movable locking members carried by said first piston, each of said members having a peripheral portion adapted to engage said annular shoulder of said first casing when said locking means are in said first position.

3. An impact device as defined in claim 1 in which one end of said second casing is close by a closure cap in which each of said locking members is provided with an aperture which is radially offset from the axial centerline of said first casing and in which said operating means comprises an axially extended elongated rod affixed proximate one end to said closure cap and affixed proximate the opposite end to said piston, said rod extending through said apertures in said locking members and including engaging means for engaging said locking members to effect radially inward movement thereof.

4. An impact device as defined in claim 3 in which said rod includes a first cylindrical portion and a spaced apart reduced diameter second portion which portions are interconnected by a cone shaped portion, the outer surface of which comprises said locking member engaging means.

5. An impact device as defined in claim 4 in which said biasing means comprises a helical compression spring encompassing said rod and disposed intermediate said closure cap and said piston.

6. An impact device for use in clearing a stoppage in a wasteline, comprising:

(a) a first generally cylindrically shaped casing having an annular shoulder at one end and being open at the opposite end;

(b) a first piston reciprocally movable within said first casing from a first to a second position;

(c) a pair of locking members carried by said first piston for radial movement from an extended position to a retracted position, each of said members having a peripheral portion adapted to engage said annular shoulder when said members are in an extended position and each of said members having an aperture therethrough, each said aperture being offset from the axial centerline of said first piston;

(d) biasing means for yieldably resisting movement of said locking members from an extended position to a retracted position;

(e) impact means for exerting an impact force against the stoppage in the waste line, said means being disposed at one end of said first casing and comprising:

(i) an anvil adapted to be forcibly impacted by said piston;

(ii) an internal chamber disposed adjacent said anvil, said anvil being movable into said chamber a limited distance upon being impacted by said piston;

(iii) a closure member for partially closing said chamber, including a protruding pipe section defining a passageway leading from said internal chamber to the exterior of the device; and (iv) a fitting removably connected to said pipe section for sealable engagement with the inlet of the waste line;

(f) a second elongated casing closed at one end and telescopically receivable over said first casing at the opposite end for telescopic movement relative to said first casing from a first to a second position;

(g) an axially disposed elongated connecting rod carried within said second casing having one end connected to said closed end of said second casing and the opposite end connected to said first piston, said rod extending through said apertures formed in said locking members and including engaging means for engaging said locking members to cause radial movement thereof from said extended position into said retracted position upon telescopic movement of said second casing to said second position; and (h) an elongated coil spring encompassing said connecting rod having one end thereof in engagement with said closed end of said second casing and having the opposite end thereof in engagement with said first piston.

7. An impact device as defined in claim 6 further including:

(a) a second piston reciprocally movable within said internal chamber in response to movement of said anvil; and (b) second biasing means for yieldably resisting movement of said piston with said internal chamber.

8. An impact device as defined in claim 7 in which said impact means includes venting means disposed in close proximity to said second piston for venting said internal chamber to atmosphere upon impact of said anvil by said piston.

9. An impact device as defined in claim 7 in which said first and second casings are each provided with a plurality of axially spaced apertures.

10. An impact device as defined in claim 6 in which said pipe section is radially offset from the axial center line of said first casing.

11. A waste line cleanout apparatus for use in clearing a stoppage in a wasteline, comprising:

(a) a first generally cylindrically shaped casing having an annular shoulder at one end and being internally threaded at the opposite end;

(b) a first piston reciprocally movable within said first casing from a first to a second position said piston having an axially extending bore therethrough;

(c) a pair of locking members carried by said first piston for radial movement from an extended position to a retracted position, each of said members having a peripheral portion adapted to engage said annular shoulder when said members are in an extended position and each of said members having an aperture therethrough, each said aperture being offset from the axial centerline of the axial bore through said piston;

(d) a generally cylindrically shaped body being externally threaded at a first end for threadable interconnection with said first casing and being internally threaded at a second opposite end;

(e) an anvil adapted for limited reciprocal movement within said cylindrically shaped body;

(f) a second piston disposed within said cylindrically shaped body proximate said anvil, said piston being reciprocally movable within said cylindrically shaped body in response to movement of said anvil;

(g) a closure member adapted to be threadably interconnected with said cylindrically shaped body at said second end, said closure member including a radially off center, generally cylindrically shaped pipe section protruding outwardly from said closure member;

(h) a helical spring disposed intermediate said second piston and said closure member for yieldably resisting reciprocal movement of said second piston within said cylindrically shaped body;

(i) a second elongated casing closed at one end and telescopically receivable over said first casing at the opposite end for telescopic movement relative to said first casing from a first to a second position;

(j) an axially disposed elongated connecting rod carried within said second casing having one end connected to said closed end of said second casing and the opposite end extending through said axially extending bore of said piston, said rod also extending through said apertures formed in said locating members and including a generally conical shaped central section adapted to engage said locking members to cause radial movement thereof from said extended position into said retracted position upon telescopic movement of said second casing to said second position; and (g) an elongated coil spring encompassing said connecting rod having one end thereof in engagement with said closed end of said second casing and having the opposite end thereof in engagement with said first piston.

* * * * *